US010974875B2

(12) United States Patent
Davis et al.

(10) Patent No.: US 10,974,875 B2
(45) Date of Patent: Apr. 13, 2021

(54) CONTAINER

(71) Applicant: LOADHOG LIMITED, Sheffield (GB)

(72) Inventors: Luke Davis, Sheffield (GB); Leigh Jowett, Sheffield (GB)

(73) Assignee: LOADHOG LIMITED

( * ) Notice: Subject to any disclaimer, the term of this patent is extended or adjusted under 35 U.S.C. 154(b) by 77 days.

(21) Appl. No.: 16/463,713

(22) PCT Filed: Jan. 5, 2018

(86) PCT No.: PCT/GB2018/000001
§ 371 (c)(1),
(2) Date: May 23, 2019

(87) PCT Pub. No.: WO2018/127685
PCT Pub. Date: Jul. 12, 2018

(65) Prior Publication Data

US 2019/0315529 A1 Oct. 17, 2019

(30) Foreign Application Priority Data

Jan. 9, 2017 (GB) ..... 1700297
Mar. 2, 2017 (GB) ..... 1703360
Jan. 4, 2018 (GB) ..... 1800081

(51) Int. Cl.
*B65D 43/16* (2006.01)
*B65D 1/42* (2006.01)
*B65D 55/02* (2006.01)

(52) U.S. Cl.
CPC ..... *B65D 43/164* (2013.01); *B65D 1/42* (2013.01); *B65D 55/02* (2013.01)

(58) Field of Classification Search
CPC ..... B65D 43/164; B65D 1/42; B65D 55/02; B65D 2543/00398; B65D 25/2897;
(Continued)

(56) References Cited

U.S. PATENT DOCUMENTS 3,324,997 A * 6/1967 Bonanno ..... B65D 43/164 206/765
5,188,233 A * 2/1993 Hammett ..... B65D 71/70 206/203

(Continued)

FOREIGN PATENT DOCUMENTS

DE 8521497 U1 9/1985
DE 20315302 U1 2/2004

(Continued)

*Primary Examiner* — Shawn M Braden
(74) *Attorney, Agent, or Firm* — Clark Hill PLC; James R. Foley

(57) ABSTRACT

A container (10) having a base (12) is disclosed. The container (10) also has an upstanding side wall (14) extending upwardly from the base (12). The base (12) has an upper face (16) and a lower face (18). The base (12) defines an external recess (20) in extending upwardly from the lower face (18). The container (10) further includes a mesh formation in the recess (20). A lid (110) for a container (1100) is also disclosed. The lid (110) comprises a first surface (118) facing in a first direction. The lid (110) also has a second surface opposite the first surface (118). The lid (110) has a rim arrangement (111) comprising a holding formation (122) having a curved convexity (126A) facing in a second direction away from the first direction. The holding formation (122) comprises a plurality of spaced retaining members (128) on said convexity (126A). The retaining members (128) extend in the second direction, and are arranged so that a securing member (124) extending across the convexity (126A) between adjacent retaining members (128) is retained on the holding formation (122) by the retaining members (128).

18 Claims, 14 Drawing Sheets

(58) Field of Classification Search
CPC ..... B65D 2501/24019; B65D 2501/24808; G07C 2009/0092
USPC ..... 220/836
See application file for complete search history.

(56) References Cited

U.S. PATENT DOCUMENTS

| | | | | |
|---|---|---|---|---|
| 5,685,452 | A * | 11/1997 | Kristoffersson | B29C 45/00 220/608 |
| 10,399,748 | B2 * | 9/2019 | Reinhart | B65D 43/0214 |
| 2012/0102880 | A1 * | 5/2012 | Korpanty | B65D 1/42 53/285 |
| 2012/0199513 | A1 * | 8/2012 | Wagner | B65D 21/0233 206/505 |
| 2014/0027335 | A1 * | 1/2014 | Chen | B65D 1/42 206/505 |
| 2014/0097186 | A1 | 4/2014 | Stolzman et al. | |
| 2015/0034657 | A1 * | 2/2015 | Lim | B65D 65/44 220/592.2 |

FOREIGN PATENT DOCUMENTS

| | | | |
|---|---|---|---|
| EP | 0989063 | A1 | 3/2000 |
| EP | 2799355 | A2 | 11/2014 |
| JP | S6278608 | U | 5/1987 |
| JP | 2013209144 | A | 10/2013 |

* cited by examiner

CONTAINER

This invention relates to containers. More particularly, but not exclusively, this invention relates to containers having polygonal bases. Embodiments of the invention relate to containers having rectangular bases. This invention relates to lids. This invention also relates to containers incorporating lids.

Containers are used to store or transport loads, but repeated use with heavy loads can cause the base of the container to sag or break. In addition, it is often necessary to attach containers to one another for transport purposes. Straps are wrapped around each container which are then stacked upon one another. A further strap is then wrapped around the stack of containers to attach them together. Unfortunately, the use of straps on known containers leaves them open to theft.

According to one aspect of this invention, there is provided a container having a base and an upstanding side wall extending upwardly from the base, wherein the base has an upper face and a lower face, wherein the base defines an external recess extending upwardly from the lower face, and the container further includes a mesh formation in the recess.

The upper face may have an upwardly extending protrusion, said protrusion defining said external recess in the base.

The base may have a polygonal configuration, which may be a rectangular configuration. The recess may have a polygonal configuration, which may be a rectangular configuration. The mesh formation may comprise a rib arrangement, which may comprise a plurality of ribs extending across the recess.

The rib arrangement may comprise a plurality of first ribs, which may be elongate. The first ribs may be substantially parallel to each other. The rib arrangement may further comprise a plurality of second ribs, which may be elongate. The second ribs may be substantially parallel to each other.

The plurality of first ribs may extend crosswise relative to the plurality of second ribs to form the aforesaid mesh formation. The plurality of first ribs may extend substantially perpendicular to the plurality of second ribs to form a plurality of rectangles.

Where the base has a rectangular configuration, the first and second ribs may extend diagonally relative to the side walls across the recess. Where the recess has a rectangular configuration, the first and second ribs may extend at an angle of approximately 45° across the recess.

The recess may have a main portion and an edge portion. The main portion may be substantially planar. The edge portion may slope upwardly. The edge portion of the recess may constitute an edge portion of the protrusion. The edge portion may extend around the main portion of the recess.

Each of the plurality of first and second ribs may terminate at the edge portion. Each of the plurality of first and second ribs may extend across the main portion.

The base may comprise a rim portion between the side wall and the recess. The rim portion may extend around the recess. Desirably, the rim portion extends wholly around the recess. The protrusion may extend upwardly from the rim portion. The edge portion of the recess may extend upwardly from the rim portion.

The rim portion may occupy between 20% and 50% of the area of the base. The rim portion may occupy between 25% and 45% of the area of the base. The rim portion may occupy between 30% and 40% of the area of the base. In one embodiment, the rim portion may occupy substantially 35% of the area of the base.

The recess may occupy between 50% and 80% of the area of the base. The recess may occupy between 55% and 75% of the area of the base. The recess may occupy between 60% and 70% of the area of the base. In one embodiment, the recess may occupy substantially 65% of the area of the base.

The rim portion may have a lower face. Each of the first and second ribs may have a lower edge that is substantially coplanar with the lower face of the rim portion.

The rim portion may have an upper face. The protrusion may have a lower surface arranged above the upper face of the rim portion. Each of the first and second ribs may have an upper edge attached to the lower surface of the protrusion. The upper edge of each rib may be above the upper face of the rim portion.

According to another aspect of this invention, there is provided a lid for a container, said lid comprising: a first surface facing in a first direction; a second surface opposite the first surface; wherein the lid has a rim arrangement comprising a holding formation having a curved convexity facing in a second direction away from the first direction; and wherein the holding formation comprises a plurality of spaced retaining members on said convexity, said retaining members extending in said second direction, and being arranged so that a securing member extending across the convexity between adjacent retaining members is retained on the holding formation by the retaining members.

According to another aspect of this invention, there is provided a lid for a container, said lid comprising: an inner surface to face an internal space defined by a body of the container when the lid is in a closed condition; an outer surface to face outwardly from the container when the lid is in the closed condition; wherein the lid has a rim arrangement having a holding formation for holding a securing member, the holding formation having an outwardly facing curved convexity; and wherein the holding formation comprises a plurality of spaced outwardly extending retaining members on said convexity, said retaining members being arranged so that the securing member extending across the convexity between adjacent retaining members is retained on the holding formation by the retaining members.

The holding formation may include a guide formation, said guide formation comprising the convexity. The guide formation may further include a planar member. The planar member may extend tangentially from the convexity. The planar member may have a distal edge.

The curved convexity may have an end profile that is an arc of a circle. The arc may be substantially a quarter of a circle.

The lid may have hinge portions for attachment to the body of the container to allow hinged movement of the lid between the closed condition and an open condition. The rim arrangement may have a connecting region for connecting the lid to the body of the container. The hinge portions may be provided on the connecting region of the rim arrangement. The connecting region may extend transverse to the aforesaid holding formation The holding formation may have an inwardly facing curved concavity. The curvature of the concavity may correspond to the curvature of the convexity. The concavity may have any inwardly facing concave surface which can engage the body of the container when the lid is in the closed condition.

The lid may have a covering portion for covering the internal space of the container. The rim arrangement may extend around the covering portion. The holding formation may be attached to the covering portion. The convexity may extend from the cover portion. The cover portion may extend substantially tangentially to the convexity.

In the embodiment described herein, each of the retaining members may have a curved portion that extends around the convexity. Each retaining member may have a straight portion that extends across the planar member. The straight portion may extend to the distal edge of the planar member.

The rim arrangement may comprise two substantially opposite holding formations, each holding formation being provided with a plurality of the aforesaid retaining members.

The rim arrangement may further include an interlocking region opposite the connecting portion, the interlocking region being provided to interlock with a similar further lid connected to the body opposite the first mentioned lid. The interlocking region may comprise a plurality of alternating recesses and projections. The recesses of each of the lid and the further lid may receive the projections of the other of the lid and the further lid when the lids are in their closed conditions.

According to another aspect of this invention, there is provided a container comprising a body defining an internal space, and a lid as described above.

The body may have a plurality of upstanding walls. The lid may be attached by said hinge portions to a first of said walls. The first wall may include further hinge portions to which the hinge portions of the lid can be connected.

The body may have a second wall, and the holding formation may engage the second wall when the lid is in the closed condition. The second wall may extend transverse to the first wall. The second wall may have an upper region defining a recess to receive the holding formation.

The upper region may be an upper edge region. The holding formation may receive the upper edge region of the second wall. At least some of the upper edge region may be received by the holding formation. At least some of the upper edge region may be received by the concavity.

The recess may have a pair of opposed steps. The recess may also have an elongate recessed portion extending between the steps. The holding formation may be received in the recess between the opposed steps. When the holding formation is received in the recess, the elongate recessed portion may be received by the holding formation. The elongate recessed formation may be received in the concavity.

The body may comprise two of the second walls, which may be arranged opposite each other. Where the rim arrangement comprises two substantially opposite holding formations, the upper region of each second wall may define a recess to receive a respective one of the holding formations.

The body may comprise a further first wall to which the lids can be connected. The further lid may be a lid as described above. The further lid may attached by hinge portions to the further first wall. The recess in the, or each, second wall may receive the holding formations of each of the lids when they are in their closed conditions.

Embodiments of the invention will now be described by way of example only, with reference to the accompanying drawings, in which.

Figure 1:
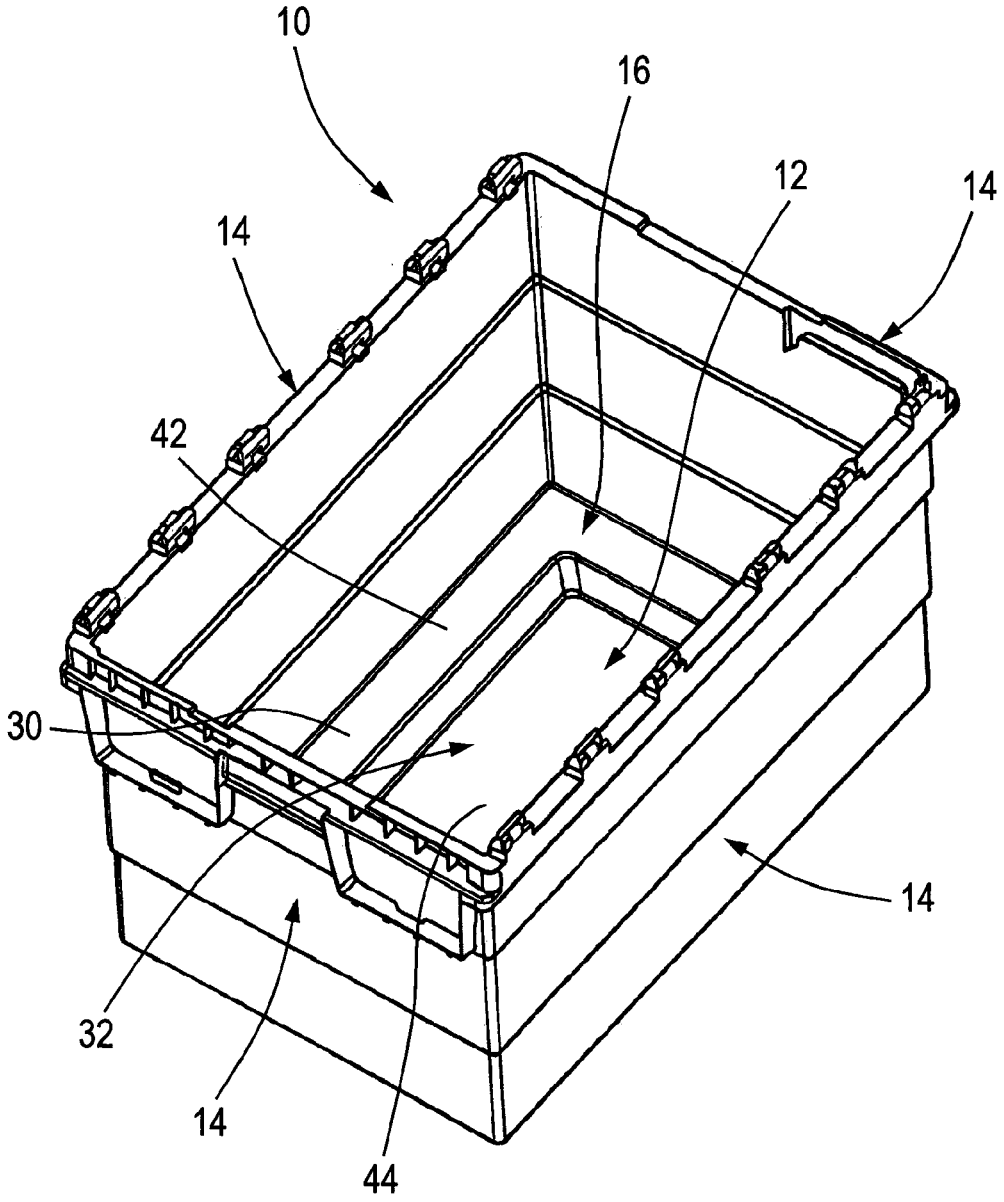
FIG. 1 is a top perspective view of a container.
Figure 2:
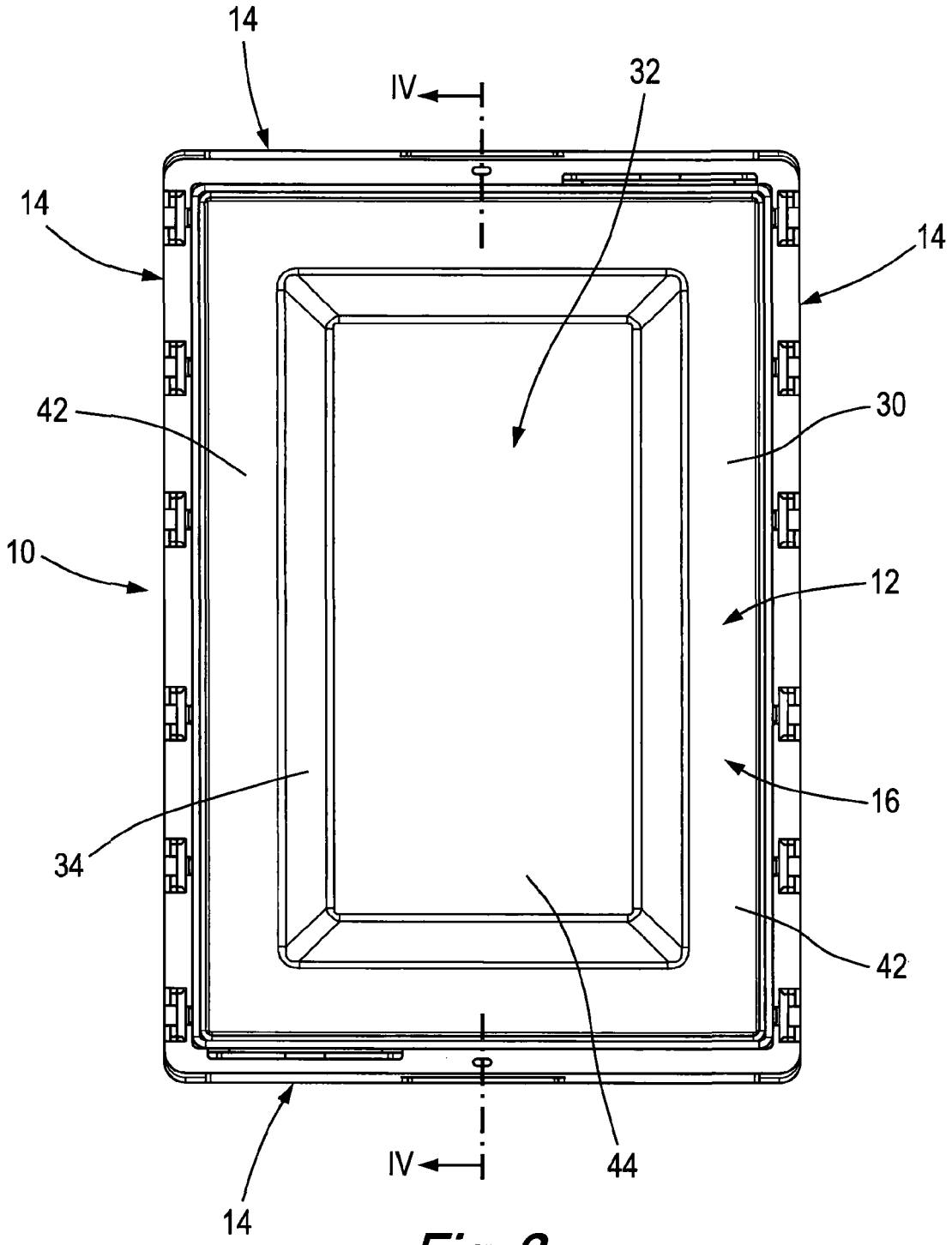
FIG. 2 is a top plan view of the container.

FIGS. 1 to 5 of the drawings show a container 10 comprising a rectangular base 12 and four upstanding side walls 14 extending upwardly from the base 12. The base 12 has an upper face 16 and a lower face 18, and defines a recess 20 extending upwardly from the lower face 18.

A reinforcing mesh formation 22 is provided within the recess 20. The mesh formation 22 is in the form of a rib arrangement comprising a plurality of ribs that extend across the recess 20. The plurality of ribs comprises a plurality of substantially parallel first ribs 24 and a plurality of substantially parallel second ribs 26.

The first ribs 24 extend crosswise relative to the second ribs 26, substantially at right angles thereto. The mesh formation 22 is, therefore, in the form of a plurality of rectangles 28 formed by the intersecting first and second ribs 24, 26.

The base 12 comprises a rim portion 30 extending from the side walls 14 to the recess 20. The rim portion 30 extends around the recess 20 and occupies a region between the upstanding side walls 14 and the recess 20. In the embodiment shown in the drawings, the rim portion 30 occupies substantially 35% of the area of the base, and the recess 20 occupies substantially 65% of the area of the base.

The base 12 has an upwardly extending protrusion 32 that defines the recess 20. The protrusion 32 extends upwardly from the rim portion 30.

The recess 20 has an edge portion 34 that slopes upwardly from the rim portion 30. The recess also has a substantially planar main portion 36 within the edge portion 34. The edge portion 34 extends wholly around the main portion 36. Each of the first and second ribs 24, 26 extends across the main portion 36 diagonally relative to the side walls 14, and terminates at the edge portion 34.

Figure 3:
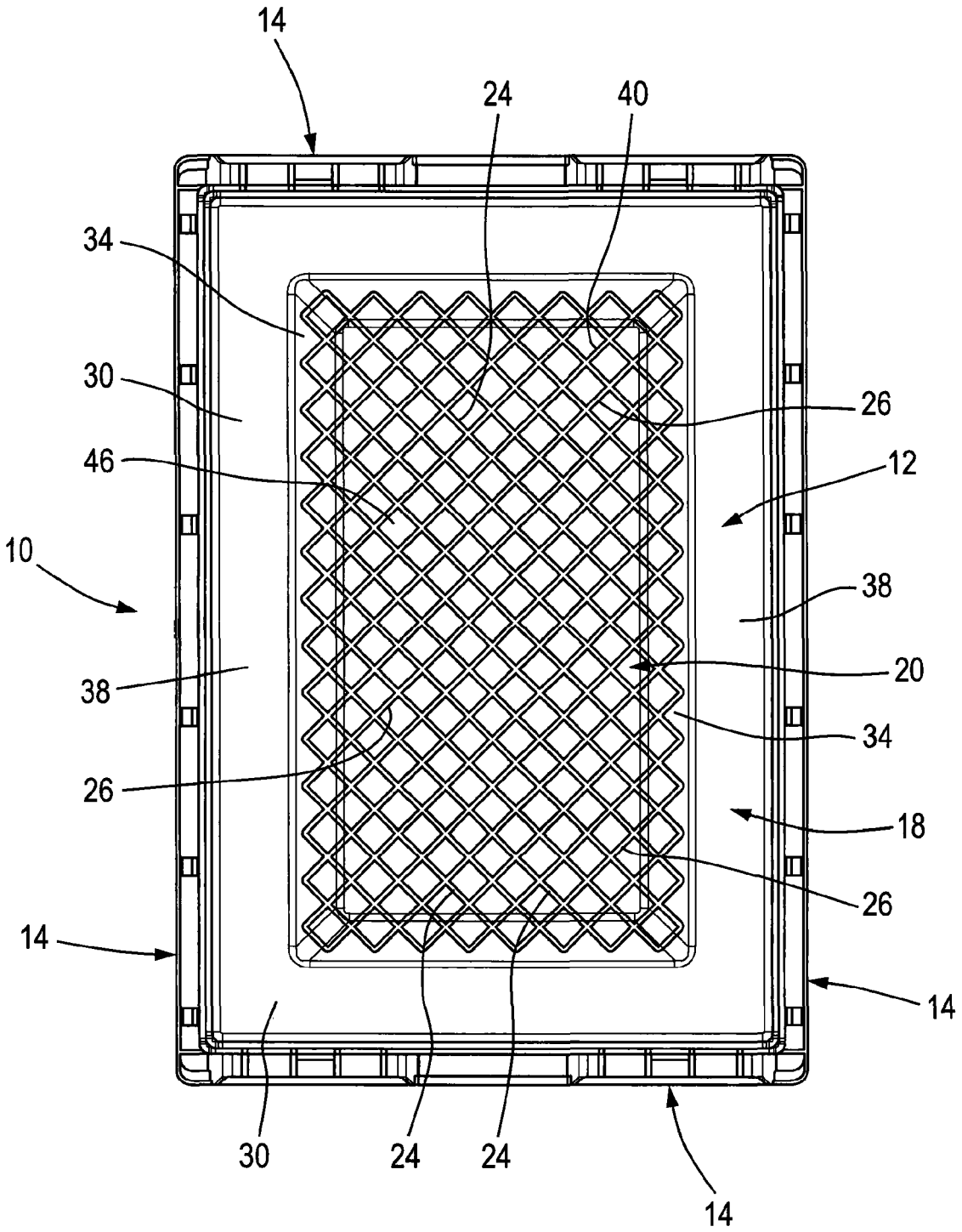
FIG. 3 is a bottom plan view of the container.
Figure 4:
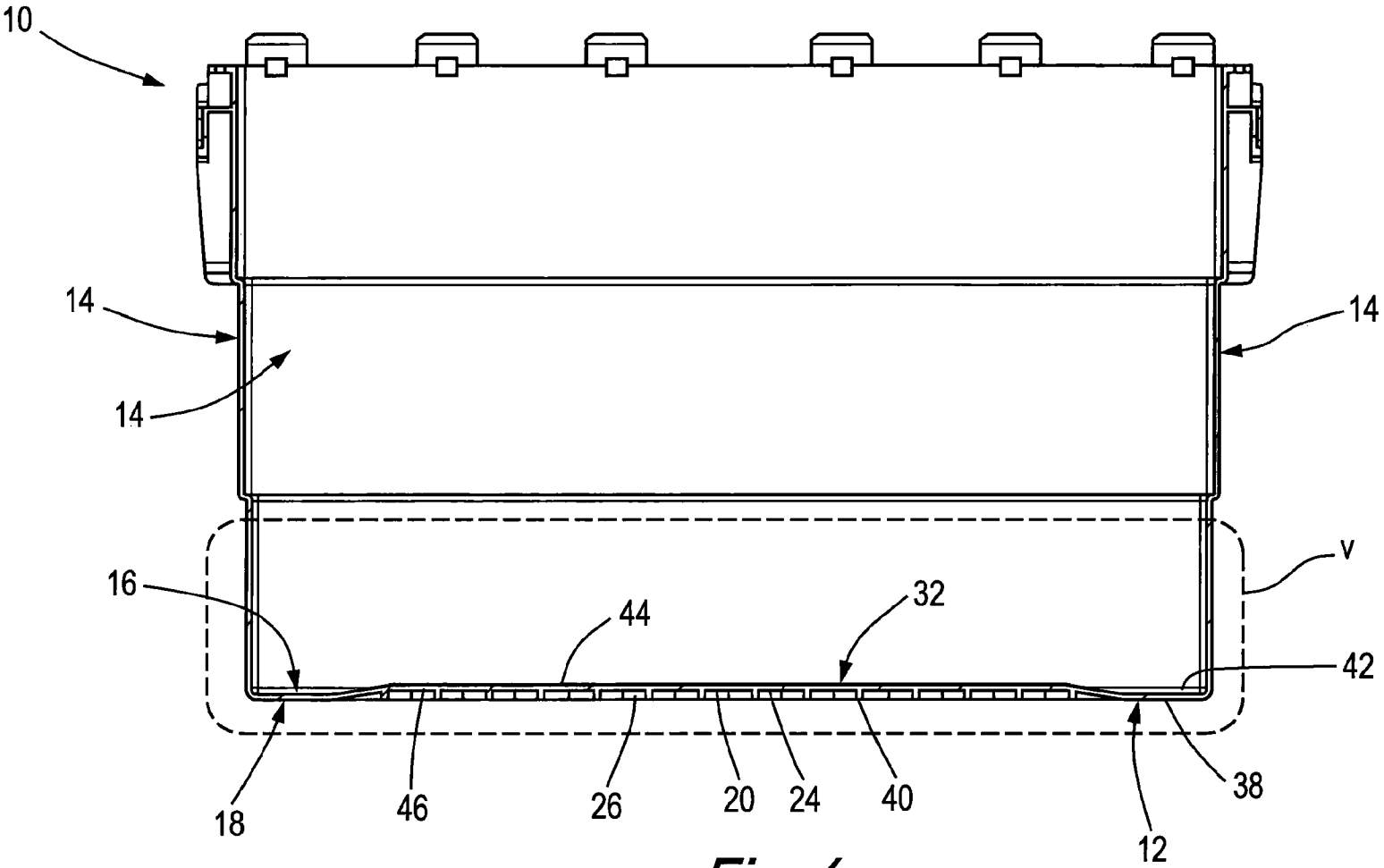
FIG. 4 is a sectional view of the container along the lines IV-IV in FIG. 2.
Figure 5:
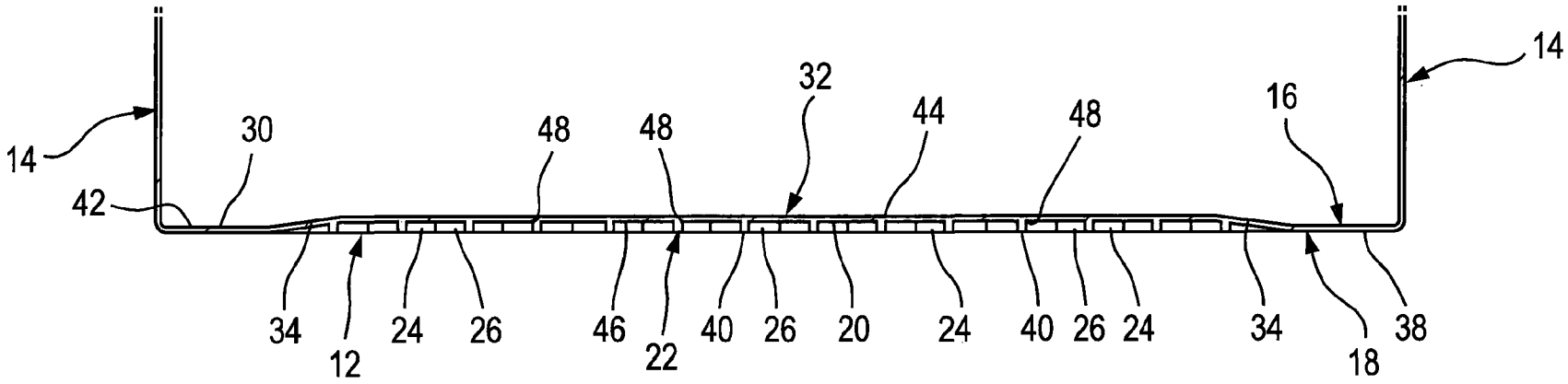
FIG. 5 is a close up view of the region marked V in FIG. 4.
Figure 6:
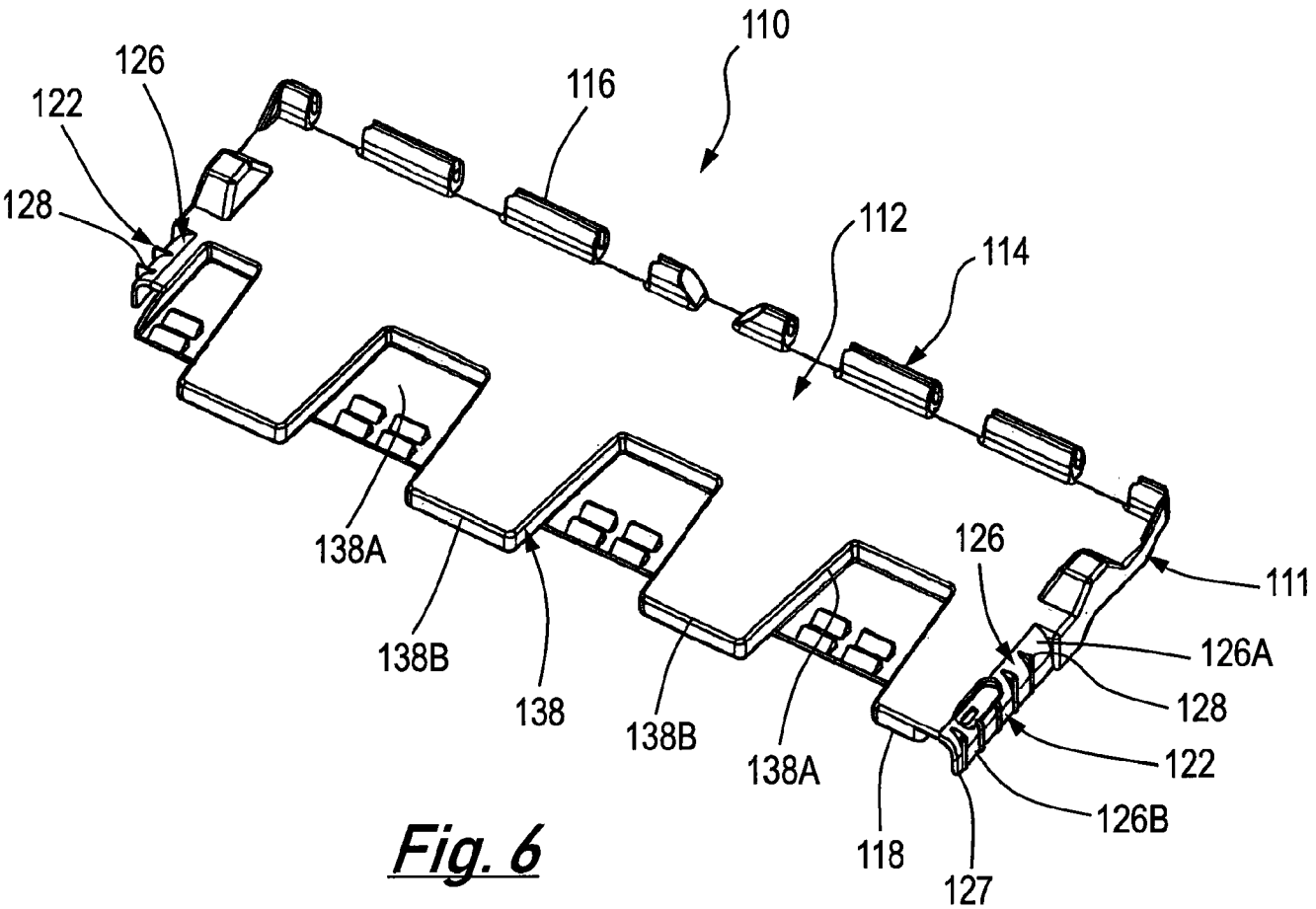
FIG. 6 is a top perspective view of a first embodiment of a lid.
Figure 7:
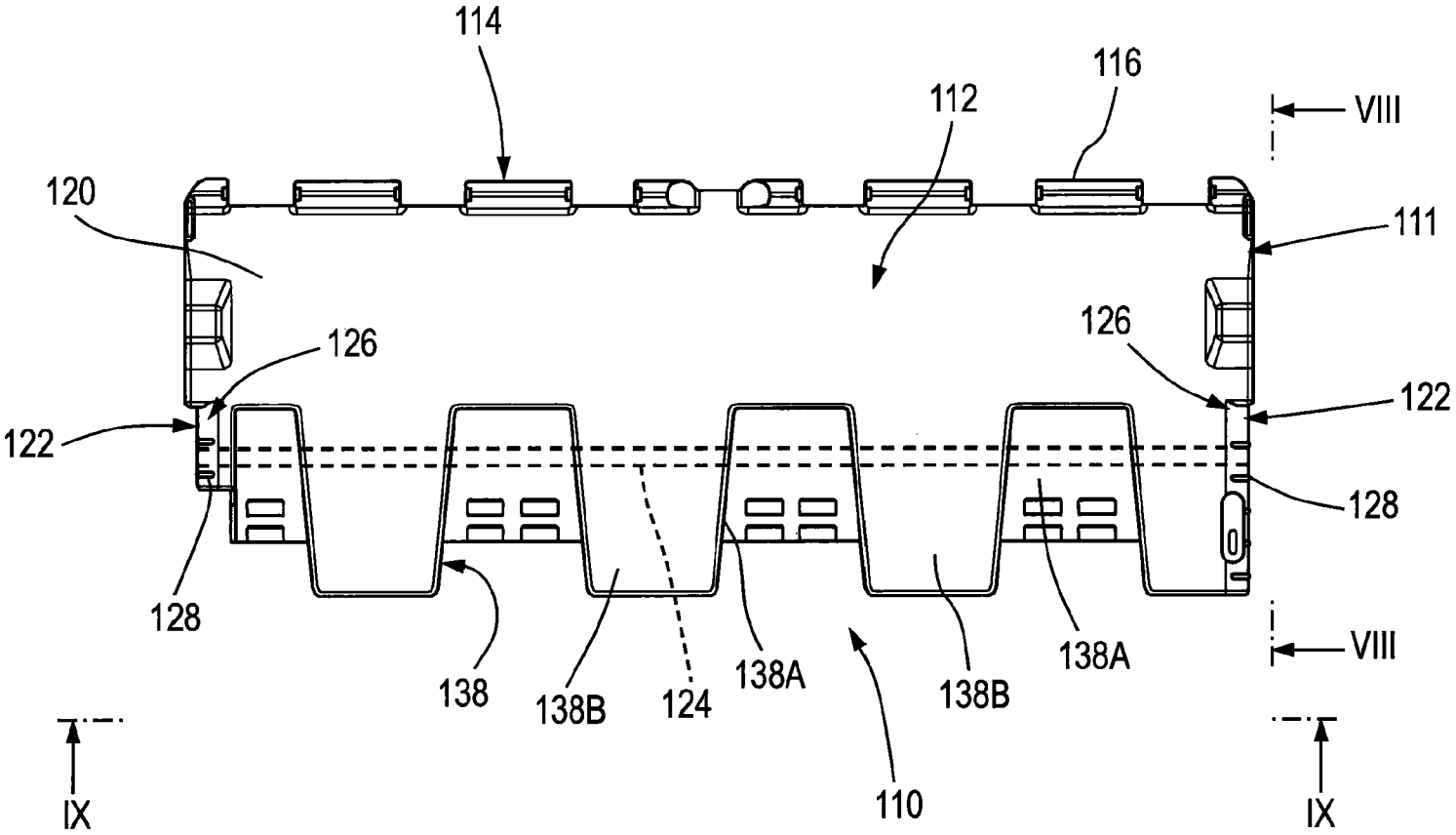
FIG. 7 is a top plan view of the lid.
Figure 8:
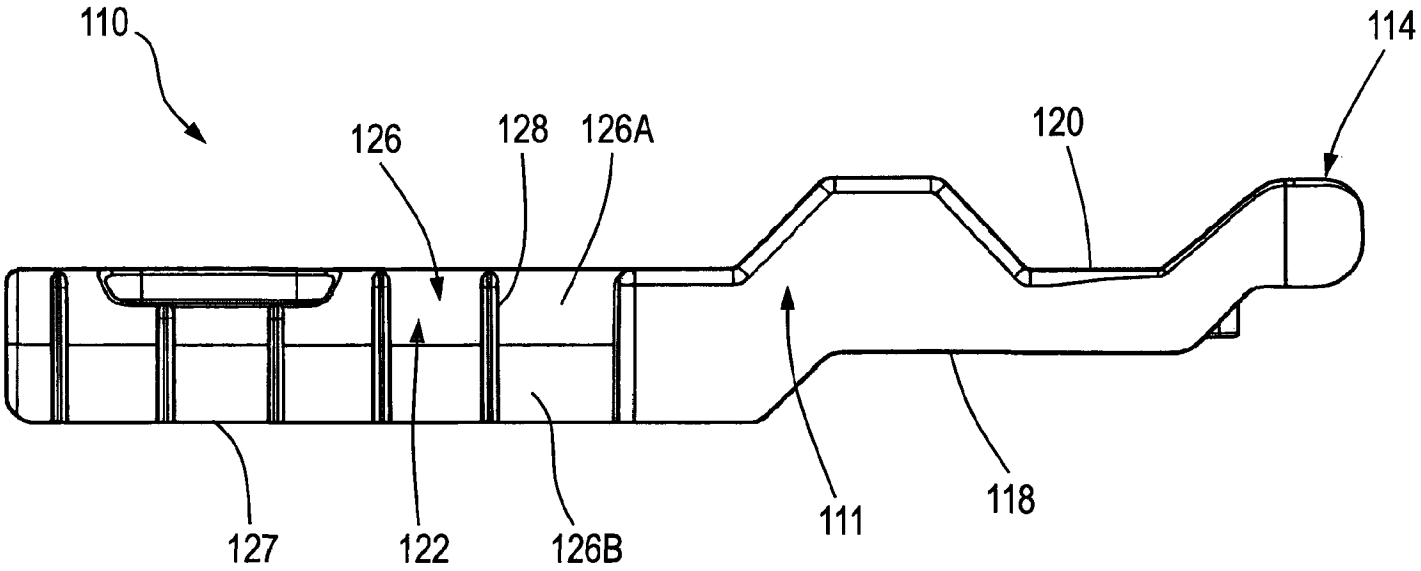
FIG. 8 is a view of the lid along the lines VIII-VIII in FIG. 7.
Figure 9:
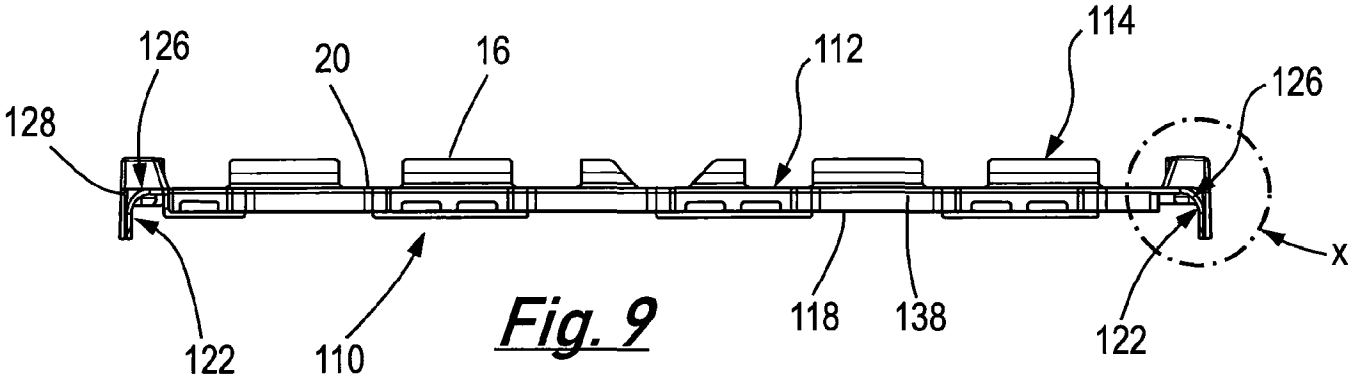
FIG. 9 is a view of the lid along the lines IX-IX in FIG. 7.
Figure 10:
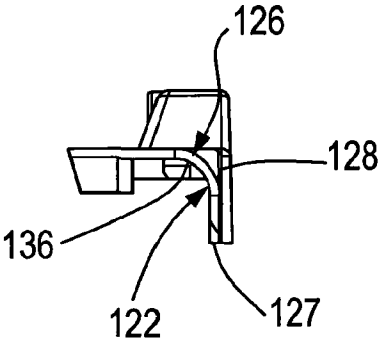
FIG. 10 is a close up of the region marked X in FIG. 9.

As can be seen from FIG. 3, the first and second ribs 24, 26 are of different lengths. The majority of the first and second ribs 24, 26 extend from the edge portion 34 across the main portion 36. However, the shorter of the first and second ribs 24, 26, at the corners of the recess 20, do not extend beyond the edge portion 34.

The rim portion 30 has a lower face 38. Each of the first and second ribs 24, 26 has a lower edge 40 that is coplanar with the lower face 38. Thus, the lower edges 40 and the lower face 38 provide a surface to engage the ground when the container 10 is disposed thereon.

The rim portion 30 has an upper face 42. The protrusion 32 has an upper surface 44 and a lower surface 46. The lower surface 46 of the protrusion 32 is arranged above the upper face 38 of the rim portion 30. Each of the first and second ribs 24, 26 has an upper edge 48 attached to the lower surface 46 of the protrusion.

There is thus described a container 10 having a reinforcing mesh formation 22 provided in a recess 20 in the base 12. The mesh formation 22 strengthens the base 12 to prevent it from sagging without any need to increase the thickness, and weight, of the base 12. The mesh formation 22 and the rim portion 20 mean that the container 10 retains its stiffness over the entirety of the base 12 while maintaining the impact resistance of the rim portion and corner regions of prior art containers.

The provision of the mesh formation 22 provides an advantage in the embodiment described herein that the overall weight of the container 10 is no greater than the weight of prior art similar containers, but there is an improvement in the strength and rigidity of the container.

The provision of the rim portion 30 and the mesh formation 22 provides a further advantage in the embodiment described herein of maintaining the stiffness of the base and reducing the risk of damaging the corners or edges of the base 12 in the event that the container 10 is dropped. Tests have shown that the container 10 is less likely to be damaged than a similar container with a 20% to 60% thicker base and no recess or mesh formation on the base.

Various modifications can be made without departing from the scope of the invention.

FIGS. 6 to 11 of the drawings show a lid 110. The lid 110 is intended to be part of a container 1100 (see FIGS. 12 and 13). The container 1100 may be the same as the container 10 described above, or may be a different container.

Figure 12:
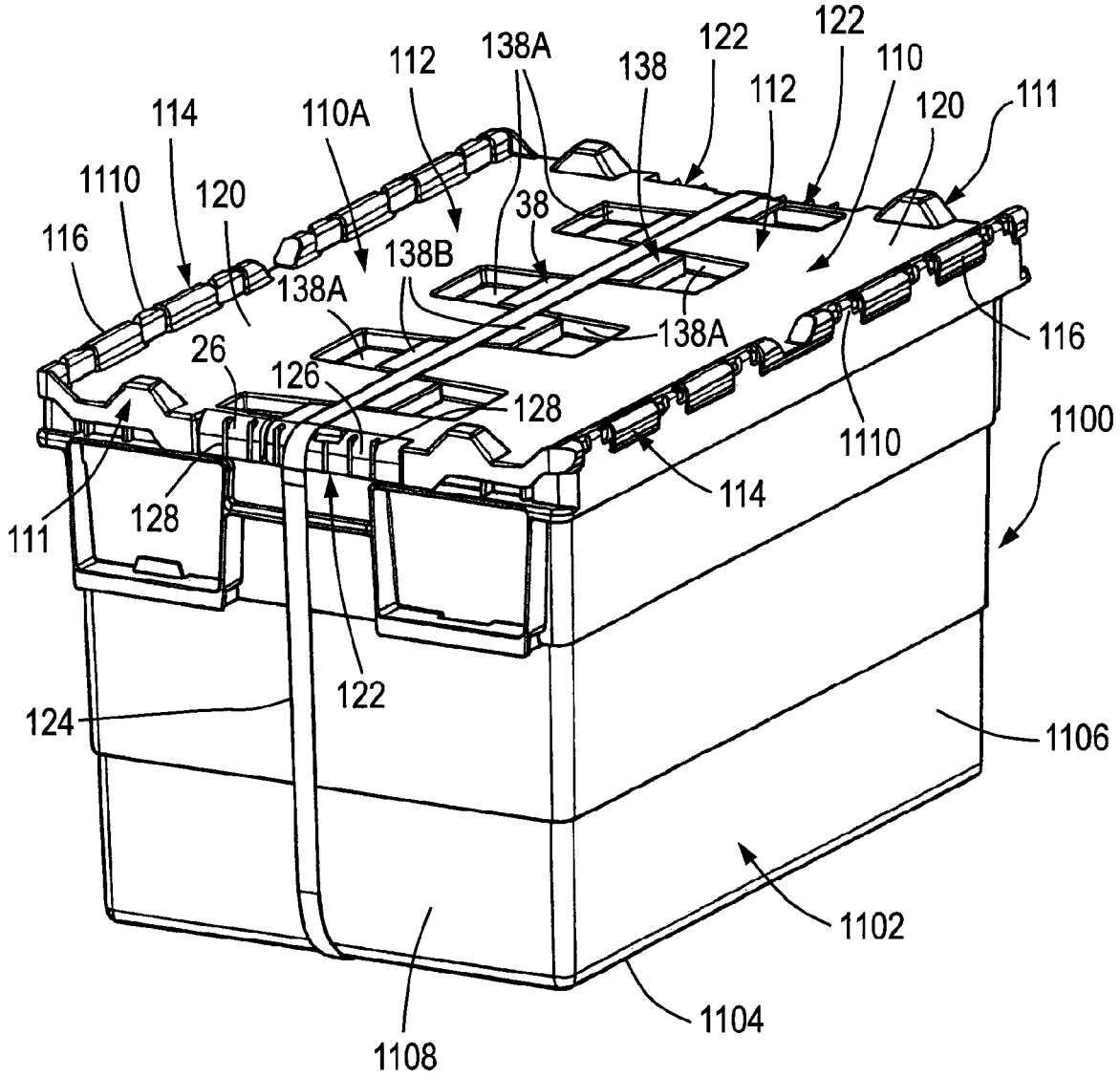
FIG. 12 is a perspective view of a container incorporating two of the lids shown in FIGS. 6 to 11.
Figure 13:
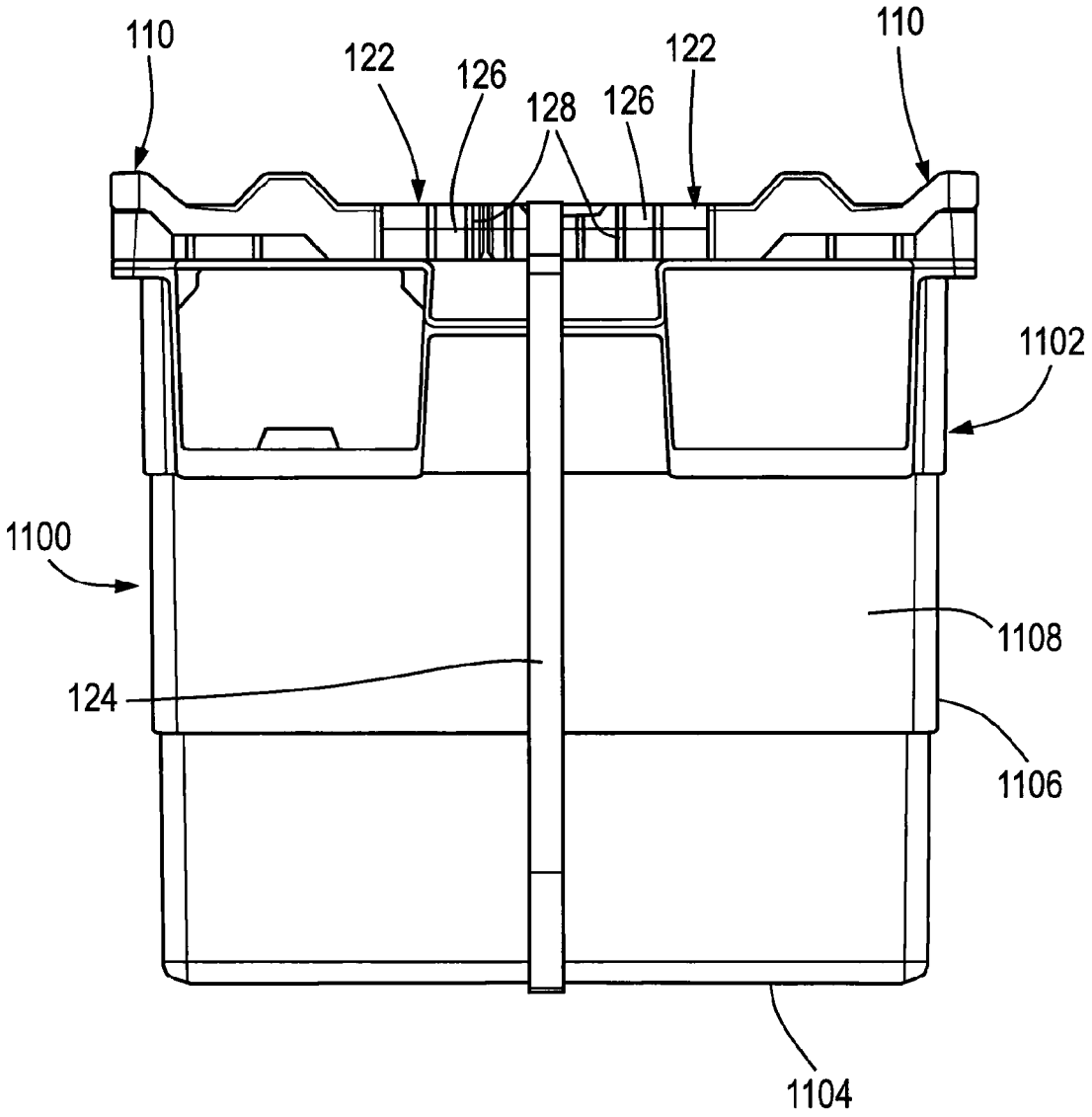
FIG. 13 is an end view of the container shown in FIG. 12.

The lid 110 comprises a cover portion 112 for covering an internal space defined by a body 1102 of the container 1100. As shown in FIG. 12, the container 1100 comprises two lids respectively designated 110 and 110A. The lid 110A is identical to the lid 110.

The body comprises a base 1104, and further includes a pair of upstanding opposite first walls in the form of side walls 1106 and a pair of opposite upstanding second walls in the form of end walls 1108 extending between the side walls 1106. The side walls 1106 and the end walls 1108 extend upwardly from the base 1104.

The lid 110 further includes a rim arrangement 111 extending around the cover portion 112. The rim arrangement 111 comprises a connecting region 114 for connecting the lid 110 to the body 1102 of the container 1100. The connecting region 114 comprises a plurality of hinge portions 116 which connect to corresponding further hinge portions 1110 on the side walls 1106. The hinged connection of the lid 110 to the body 1102 allows the lid 110 to move pivotally between open and closed conditions.

The cover portion 112 has a first surface 118 in the form of an inner surface which faces the internal space defined by the body 1102 of the container 1100 when the lid 110 is in the closed condition. The cover portion 112 also has a second surface 120 opposite the first surface 118. The second surface 120 is in the form of an outer surface, which faces outwardly when the lid 110 is in the closed condition.

The rim arrangement 111 further includes opposite holding formations 122 for holding a securing member, in the form of a strap 124 (shown in broken lines in FIG. 7), across the lid 110. Each holding formation 122 comprises a guide formation 126.

The guide formation 126 has a convexity 126A which faces outwardly. The guide formation 126 further includes a planar member 126B extending tangentially from the convexity 126A.

The convexity 126A has an end profile in the shape of arc extending over substantially a quarter of a circle. The planar member 126B has a distal edge 127 spaced from the convexity 126A.

Figure 11:
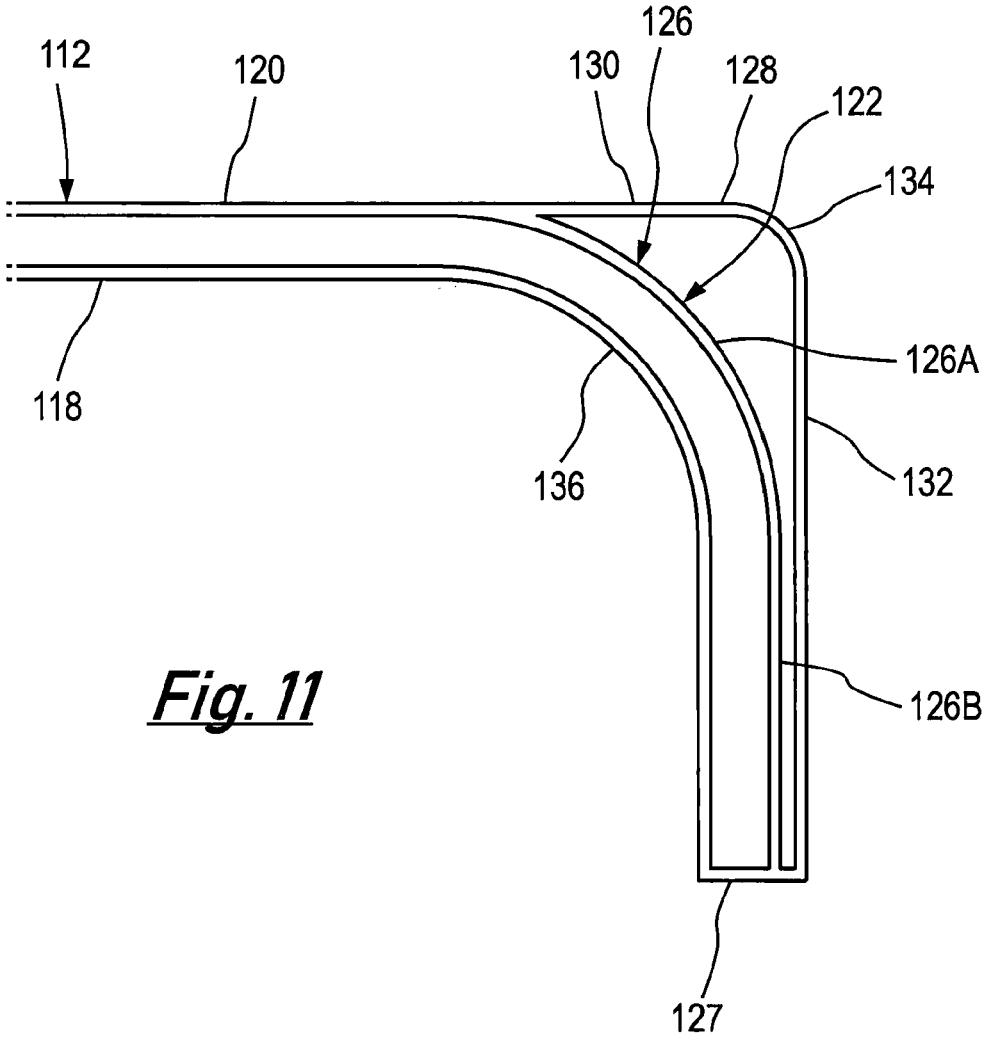
FIG. 11 is a close up end view of the holding formation shown in FIGS. 9 and 10.

The holding formation 122 is shown in more detail in FIG. 11. The convexity 126 extends from the cover portion 112 and is arranged so that the cover portion 112 is tangential to the convexity 126.

Each holding formation 122 further includes a plurality of retaining members 128 extending outwardly from the guide formation 126. Each retaining member 128 has first and second edges 130, 132 that meet at an apex 134. The first edge 130 is coplanar with the second surface 120 of the cover portion 112. The second edge 132 of each retaining member 128 extends to the distal edge 127 of the planar member 126B.

Figure 14:
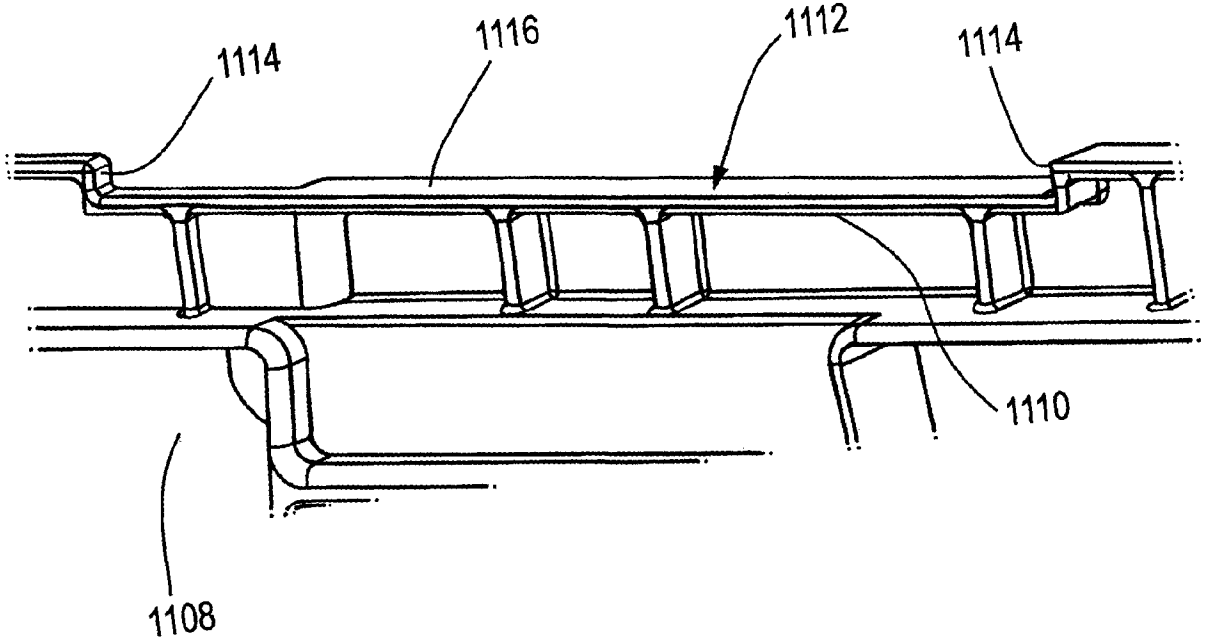
FIG. 14 is a close up view of a top edge of one of the walls of the container.

Each holding formation 122 further includes an inwardly facing concavity 136 having an internal surface that has a curvature that corresponds to the curvature of the convexity 126. When the lid 110 is in the closed condition, the concavity 136 engages the body 1102 of the container 1100. FIG. 14 shows a top edge 1110 of one of the end walls 1108. The top edge 1110 defines an elongate recess 1112 to receive one of the holding formations 122 of each lid 110. The recess 1112 has a pair of opposed steps 1114 and an elongate recessed portion 1116 extending between the steps 1114. The holding formation 122 is received in the recess 1112 between the opposed steps.

When the holding formations 122 on one side of each lid 110 are received in the recess 1112, the elongate recessed portion 1112 is received in the concavities 136 of the holding formations 122.

In use, the lid 110 can be secured in the closed, condition by the strap 124 secured around the container 1100. The strap 124 extends between adjacent retaining members 128 on each of the holding formations 122 and is tightened around the container 1100. The retaining members 128 prevent the strap 124 from being slid 110 off the lid 110, thereby helping to ensure that the lid 110 remains closed by the strap 124 and articles inside the container 1100 cannot be stolen.

The rim arrangement 111 also includes an interlocking region 138 opposite the connecting portion. The interlocking region 138 is provided to interlock with a similar further lid 110A connected to the body opposite the lid 110.

The interlocking region 138 comprises a plurality of alternating recesses 138A and projections 138B. As shown in FIG. 12, when the lid 110 and the further lid 110A are in their closed conditions, the recesses 138A of the lid 110 receive the projections 138B of the similar further lid 110A, and the projections 138B of the lid 110 are received by the recesses 138A of the further lid 110A. This secures the lids 110, 110A to one another in their closed conditions.

Various modifications can be made without departing from the scope of the invention. For example, a different number of the retaining members 128 of each holding formation 122 of the lid 110 could be provided.

Figure 15:
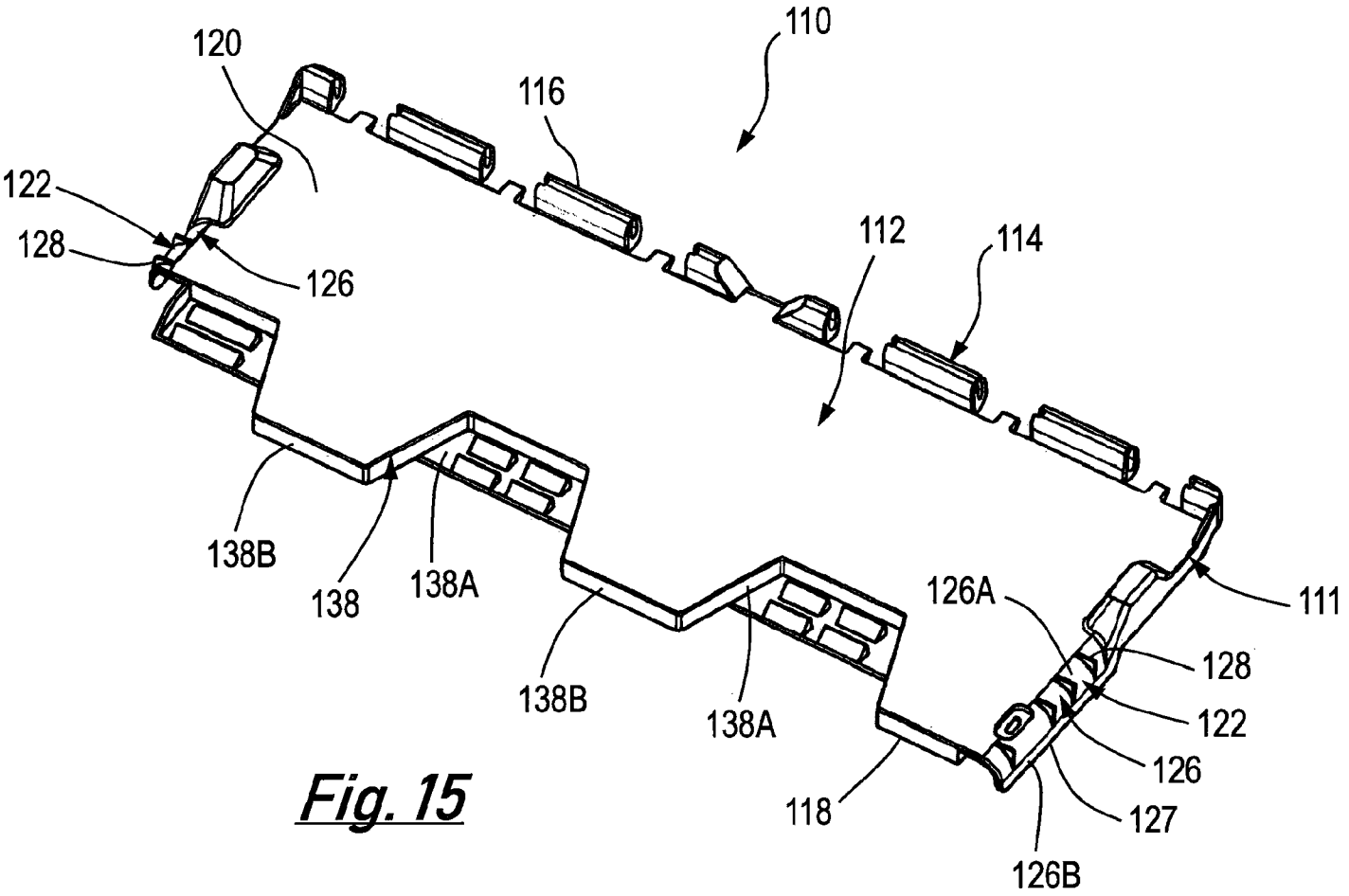
FIG. 15 is a top perspective view of a second embodiment of the lid.

FIG. 15 shows a second embodiment of the lid 110, which comprises many of the features of the lid 110 shown in FIGS. 6 to 14. These features are designated in FIG. 15 with the same reference numerals as the corresponding features in FIGS. 6 to 14.

The lid 110 shown in FIG. 15 differs from the lid 110 shown in FIGS. 6 to 14, in that the interlocking region 138 of lid 110 shown in FIG. 15 has recesses 138A and projections 38B that are smaller than the recesses 138A and the projections 138B.

In addition, the retaining formations 128 extend only around the convexity and do not extend to the distal edge 127 of the planar member 126B.

The invention claimed is:

1. A container having: a rectangular base and four upstanding side walls extending upwardly from the base; wherein the base has an upper face and a lower face, and wherein the base defines an external recess extending upwardly from the lower face, the upper face having an upwardly extending protrusion, the protrusion defining said external recess in the base; and the container further includes a mesh formation in the recess; wherein the mesh formation comprises a rib arrangement comprising a plurality of elongate first ribs and a plurality of elongate second ribs; wherein the base has a rectangular configuration, and the first and second plurality of ribs extend across the recess diagonally relative to the side walls; and wherein the base comprises a rim portion between the side wall and the recess, the rim portion extending around the recess; the rim portion having a lower face, and each of the first and second plurality of ribs having a lower edge that is substantially coplanar with the lower face of the rim portion.

2. A container according to claim 1, wherein the first ribs are substantially parallel to each other, and wherein the second ribs are substantially parallel to each other.

3. A container according to claim 2, wherein the plurality of first ribs extend crosswise relative to the plurality of second ribs to form the aforesaid mesh formation.

4. A container according to claim 3, wherein the plurality of first ribs extend substantially perpendicular to the plurality of second ribs to form a plurality of rectangles.

5. A container according to claim 1, wherein the first and second plurality of ribs extend at an angle of approximately 45° to the side wall across the recess.

6. A container according to claim 1, wherein the recess has a main portion and an edge portion, the edge portion sloping upwardly from the main portion.

7. A container according to claim 6, wherein each of the first and second plurality of ribs terminates at the edge portion.

8. A container according to claim 1, wherein the rim portion occupies between 20% and 50% of the area of the base.

9. A container according to claim 8, wherein the rim portion occupies between 25% and 45% of the area of the base.

10. A container according to claim 8, wherein the rim portion occupies between 30% and 40% of the area of the base.

11. A container according to claim 8, wherein the rim portion occupies substantially 35% of the area of the base.

12. A container according to claim 1, wherein the recess occupies between 50% and 80% of the area of the base.

13. A container according to claim 12, wherein the recess occupies between 55% and 75% of the area of the base.

14. A container according to claim 12, wherein the recess occupies between 60% and 70% of the area of the base.

15. A container according to claim 12, wherein the recess may occupy substantially 65% of the area of the base.

16. A container according to claim 1, wherein the protrusion extends upwardly from the rim portion.

17. A container according to claim 1, wherein the rim portion has an upper face, and the protrusion has a lower surface arranged above the upper face of the rim portion.

18. A container according to claim 17, wherein the each of the first and second plurality of ribs has an upper edge attached to the lower surface of the protrusion, the upper edge of each rim being above the upper face of the rim portion.

* * * * *